US009108170B2

(12) United States Patent
Wang et al.

(10) Patent No.: US 9,108,170 B2
(45) Date of Patent: Aug. 18, 2015

(54) MIXING IMPELLER HAVING CHANNEL-SHAPED VANES

(76) Inventors: Li Wang, Coquitlam (CA); Tianzhi Wang, Coquitlam (CA)

( * ) Notice: Subject to any disclaimer, the term of this patent is extended or adjusted under 35 U.S.C. 154(b) by 812 days.

(21) Appl. No.: 13/304,368

(22) Filed: Nov. 24, 2011

(65) Prior Publication Data

US 2013/0136617 A1 May 30, 2013

(51) Int. Cl.
*B01F 7/18* (2006.01)
*B01F 7/00* (2006.01)

(52) U.S. Cl.
CPC ..... *B01F 7/00275* (2013.01); *B01F 7/00466* (2013.01); *B01F 7/00591* (2013.01); *B01F 7/18* (2013.01)

(58) Field of Classification Search
CPC ..... B01F 7/00383; B01F 7/00483; B01F 7/00275
USPC ..... 366/317, 325.1, 329.1, 329.2; 416/228, 416/235, 237
See application file for complete search history.

(56) References Cited

U.S. PATENT DOCUMENTS

| | | | | | |
|---|---|---|---|---|---|
| 1,084,210 | A | * | 1/1914 | Howard | 366/302 |
| 1,940,318 | A | * | 12/1933 | Morse | 416/210 R |
| 2,045,919 | A | | 6/1936 | Parraga | |
| 2,350,939 | A | | 6/1944 | Sprouse | |
| 2,384,952 | A | * | 9/1945 | Miller | 366/325.1 |
| 2,978,233 | A | * | 4/1961 | Kingsley | 366/262 |
| 4,519,715 | A | | 5/1985 | Golobic et al. | |
| 4,548,765 | A | * | 10/1985 | Hultholm et al. | 261/93 |
| 4,779,990 | A | | 10/1988 | Hjort et al. | |
| 5,037,209 | A | | 8/1991 | Wyss | |
| 5,152,606 | A | | 10/1992 | Borraccia et al. | |
| 5,198,156 | A | | 3/1993 | Middleton et al. | |
| RE34,386 | E | | 9/1993 | Davidson et al. | |
| 5,246,289 | A | | 9/1993 | Middleton et al. | |
| 5,316,443 | A | | 5/1994 | Smith | |
| 5,791,780 | A | | 8/1998 | Bakker | |
| 5,813,837 | A | | 9/1998 | Yamamoto et al. | |
| 5,904,423 | A | | 5/1999 | Forschner et al. | |
| 5,988,604 | A | * | 11/1999 | McWhirter | 261/91 |
| 6,000,840 | A | | 12/1999 | Paterson | |
| 6,190,033 | B1 | | 2/2001 | Rickman | |
| 6,241,381 | B1 | * | 6/2001 | Noda et al. | 366/262 |
| 6,877,959 | B2 | * | 4/2005 | McWhirter | 416/228 |
| 6,896,246 | B2 | | 5/2005 | Weetman et al. | |
| 6,955,461 | B2 | | 10/2005 | Kar et al. | |
| 7,114,844 | B2 | * | 10/2006 | Weetman | 366/328.3 |

(Continued)

FOREIGN PATENT DOCUMENTS

| | | |
|---|---|---|
| CA | 451893 D | 12/1948 |
| WO | WO 2007/125586 | 11/2007 |

(Continued)

*Primary Examiner* — Charles Cooley
*Assistant Examiner* — Marc C Howell
(74) *Attorney, Agent, or Firm* — Cameron IP

(57) ABSTRACT

The present invention relates to a mixing impeller for an agitator. The impeller has a body that may be disc-shape. The impeller has a plurality of radially spaced-apart, longitudinally curved, channel-shaped outer vanes connected to and extending outwards from the body in a plurality of different directions. A first one of the outer vanes has a distal end at least partially facing above the body. A second one of the outer vanes has a distal end at least partially facing below the body. A third one of the outer vanes has a distal end at least partially facing tangential to the body.

18 Claims, 8 Drawing Sheets

(56) References Cited

U.S. PATENT DOCUMENTS

| | | | | |
|---|---|---|---|---|
| 7,172,337 | B2 | 2/2007 | Roszczenko et al. | |
| 7,296,925 | B2 | 11/2007 | Himmelsbach et al. | |
| 7,401,974 | B2 | 7/2008 | Himmelsbach | |
| 7,874,071 | B2 | 1/2011 | Tobler | |
| 7,887,230 | B2 | 2/2011 | Rosso et al. | |
| 8,220,986 | B2 | 7/2012 | Janz et al. | |
| 2006/0251554 | A1 | 11/2006 | Doucet et al. | |
| 2008/0199321 | A1 * | 8/2008 | Gigas et al. | 416/223 R |
| 2009/0231952 | A1 * | 9/2009 | Higbee et al. | 366/247 |
| 2009/0274560 | A1 * | 11/2009 | Kubota et al. | 416/228 |

FOREIGN PATENT DOCUMENTS

| | | | |
|---|---|---|---|
| WO | WO 2009/082676 | * | 7/2009 |
| WO | WO 2011/082776 | | 7/2011 |

* cited by examiner

MIXING IMPELLER HAVING CHANNEL-SHAPED VANES

FIELD OF THE INVENTION

The present invention relates to a mixing impeller. In particular, the invention relates to a mixing impeller having longitudinally curved, channel-shaped vanes.

DESCRIPTION OF THE RELATED ART

U.S. Pat. No. 5,791,780 to Bakker shows an impeller assembly for agitating a fluid contained in a vessel and dispersing a gas introduced therein. The impeller assembly includes an impeller having a plurality of generally radially extending blades. Each of the blades includes diverging upper and lower sheet-like portions having generally radially extending leading edges. The upper and lower portions are joined to form a generally V-shaped cross-section with a trailing vertex. The width of the upper portion of each blade is greater than the width of the lower portion of the blade such that the upper portion leading edge extends forwardly of the lower portion leading edge, thus producing an upper portion overhang to capture and disperse rising gas bubbles. The impeller assembly further comprises a drive assembly for rotating the impeller assembly.

U.S. Pat. No. 5,246,289 to Middleton et al. shows an agitator assembly for use in effecting dispersion of a fluid such as a gas in a liquid. The assembly comprises a rotor having a rotatably driven shaft mounting a series of scoop-shaped blades which are oriented with the mouths of the scoops presented in the direction of rotation of the shaft. Each blade is mounted at an angle of attack such that one end of the blade leads the other in the direction of rotation. To eliminate gas cavity formation, each blade is of a generally streamlined configuration in section and the ends thereof are generally transverse to the axis of rotation of the rotor.

U.S. Pat. No. 5,037,209 to Wyss shows a stirring mechanism, with a plurality of hollow, at least partially conically shaped stifling elements. These elements are provided with two openings, are symmetrically offset and are fixed on the stifling shaft at least approximately tangential to an imaginary circular cylinder coaxial to the stifling shaft. In the starting phase, the stirred substance flows laminarly through the stifling elements. However, as soon as they have reached a predetermined minimum velocity of about 1.3 m/s, the flow inside the stirring elements is forced to reverse by dynamic pressure.

BRIEF SUMMARY OF INVENTION

The present invention provides, and it is an object of the present invention to provide, an improved mixing impeller.

There is accordingly provided a mixing impeller for an agitator. The impeller has a body. The impeller has a plurality of radially spaced-apart, longitudinally curved, channel-shaped outer vanes connected to and extending outwards from the body in a plurality of different directions.

There is also provided a mixing impeller for an agitator. The impeller has an axis of rotation and includes an annular body having a top and a bottom. The impeller has a plurality of radially spaced-apart, channel-shaped, tapered outer vanes connected to and extending outwards from the top and the bottom of the body. Each of the outer vanes has a proximal end connected to the body and a distal end radially spaced-apart from the proximal end. The distal ends are smaller in cross-section relative to the proximal ends. At least one of the outer vanes is configured to extend axially outwards relative to the axis of rotation. At least another of the outer vanes is configured to extend radially outwards. At least a further of the outer vanes is configured to be at least partially bisected by the body. The distal end of a first one of the outer vanes at least partially faces above the body. The distal end of a second one of the outer vanes at least partially faces below the body. The distal end of a third one of the outer vanes at least partially faces tangential to the body.

BRIEF DESCRIPTION OF DRAWINGS

The invention will be more readily understood from the following description of preferred embodiments thereof given, by way of example only, with reference to the accompanying drawings, in which.

DESCRIPTION OF THE PREFERRED EMBODIMENTS

Figure 1:
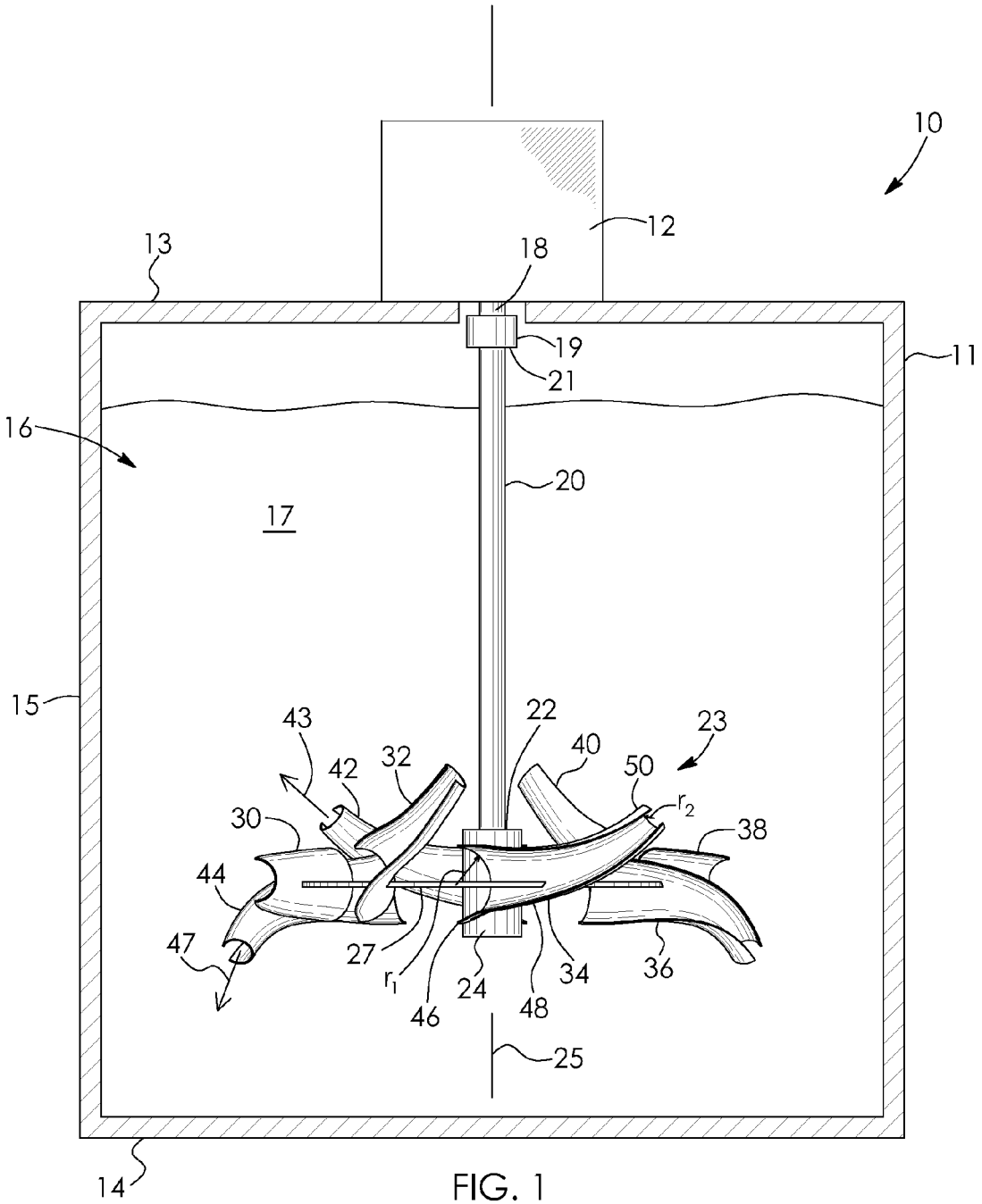
FIG. 1 is a side elevation view of an agitator assembly, showing a tank in section, a motor and gear box assembly mounted to the tank, and an impeller according to a first embodiment, the impeller being connected to the motor.

Referring to the drawings and first to FIG. 1, there is shown an agitator assembly 10. The assembly has a housing, in this example a tank 11. The assembly 10 has an actuator, in this example an electric motor and gear box assembly 12 mounted to the tank. The motor and gear box assembly is conventional and well known to those skilled in the art. Its parts and operation per se will therefore not be described in detail. The tank 11 is cylindrically-shaped in this example, and has a top 13, a bottom 14 opposite the top, and a curved, peripheral side 15 in this example extending between the top and bottom. The tank 11 has an interior 16 within which is disposed a substance to be mixed, in this example a liquid 17. In another embodiment, the tank may contain solid materials or a liquid-solid mixture to be mixed. The agitator assembly 10 may be used, for example, in the chemical industry or in a waste management system.

The motor and gear box assembly 12 has a stub shaft 18. The assembly 10 includes a coupling member 19 and an agitator shaft 20. The agitator shaft has a first end 21 and a second end 22 opposite the first end. The coupling member 19 couples the first end of the agitator shaft 20 to the stub shaft 16 of the motor. Shaft 20 is thus rotatably connected to the motor and gear box assembly 12.

The agitator assembly 10 has a mixing impeller 23 mounted to the second end 22 of the shaft 20. The impeller includes a centrally disposed hub 24, in this example. The hub has an aperture 26, best shown in FIG. 3, configured to receive the second end of the shaft. Referring back to FIG. 1, the shaft 20 may be keyed to the hub 24 for connecting to the hub and shaft together. The impeller 23 has an axis of rotation 25 around which shaft 20 and impeller 23 rotate.

Figure 2:
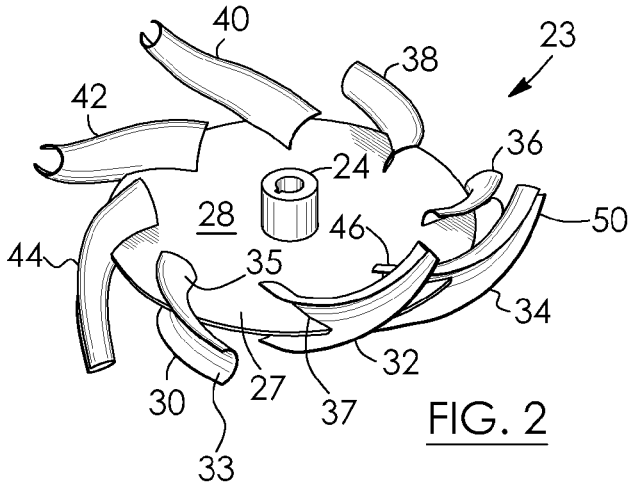
FIG. 2 is a top perspective view of the impeller shown in FIG. 1.
Figure 3:
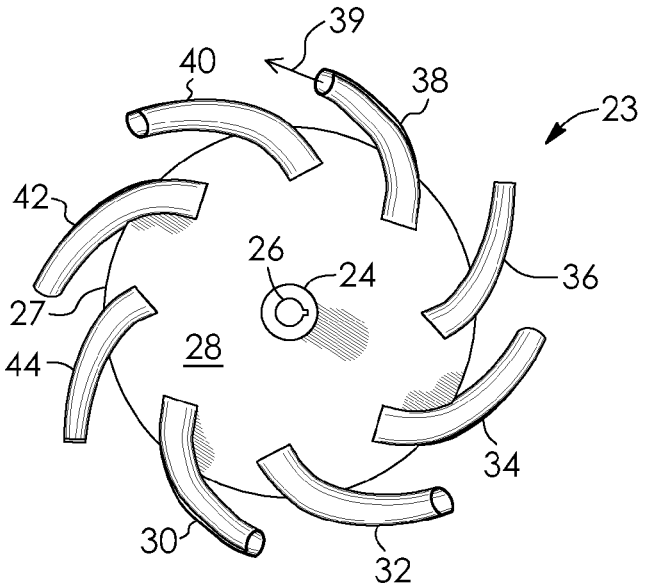
FIG. 3 is a top plan view of the impeller shown in FIG. 1.
Figure 4:
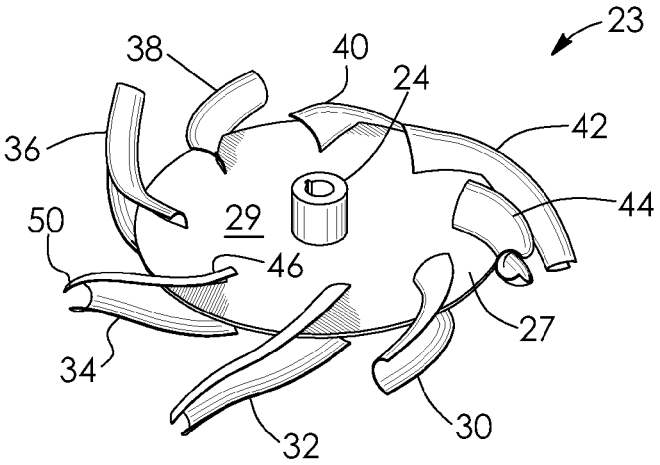
FIG. 4 is a bottom perspective view of the impeller shown in FIG. 1.

As seen in FIG. 3, the impeller 23 has disc-shaped body 27. The body has a top 28 shown in FIGS. 2 and 3 facing the top 13 of the tank 11 shown in FIG. 1. Referring to FIG. 4, the body 27 has a bottom 29 opposite its top. The bottom of the body faces the bottom 14 of the tank shown in FIG. 1.

Referring to FIG. 2, the impeller 23 has a plurality of radially spaced-apart, channel-shaped, longitudinally curved outer vanes 30, 32, 34, 36, 38, 40, 42, and 44, each vane thus being curved in a direction extending between its proximal end and its distal end as seen in FIG. 3. While eight vanes are shown in this example, this number of vanes is not strictly required and there may be a different number of vanes in other embodiments.

The outer vanes 30, 32, 34, 36, 38, 40, 42, and 44 extend outwards from the body 28 in a plurality of different directions. Vanes 30, 32, 34 and 36 are radially spaced-apart by 180 degrees relative to vanes 38, 40, 42 and 44, respectively. The outer vanes 30, 32, 34, 36, 38, 40, 42, and 44 are channel-shaped and c-shaped in section with a convex side and a concave side, as shown in FIG. 2 by concave side 33 and convex side 35 for vane 30.

Each of the outer vanes has a proximal end connected to the body. This is shown in FIG. 4 for vane 34 by its proximal end 46. The proximal ends of the outer vanes connect to both the top 28 and the bottom 29 of the body 27, with the body bisecting the proximal ends of the vanes in this example and the vanes disposed through radially extending and spaced-apart, curved slots of the body. This is shown by slot 37 for vane 32 in FIG. 2. Each of the outer vanes tapers towards a distal end which is radially spaced-apart from the proximal end, in this embodiment. This is shown by distal end 50 for vane 34. In this embodiment, the channel-shaped distal ends 50 are smaller in cross-section relative to the channel-shaped proximal ends 46. Each outer vane has a radius of curvature r. The radius of curvature $r_1$ at the proximal ends 46 of the outer vanes is greater than the radius of curvature $r_2$ at the distal ends 50 of the outer vanes in this example.

Figure 5:
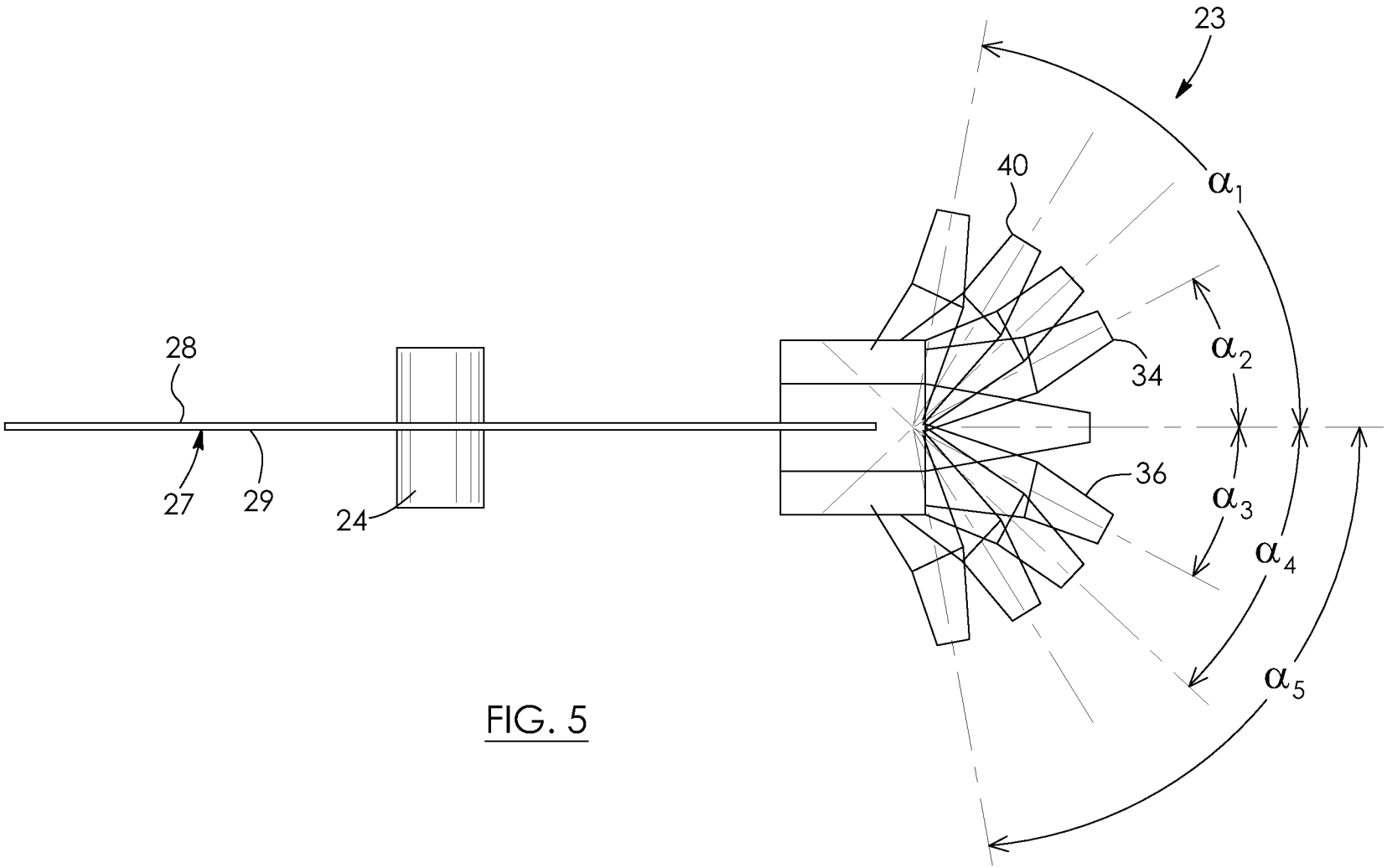
FIG. 5 is a side elevation fragmented view of the impeller shown in FIG. 1, with a plurality of outer vanes being shown angularly spaced-apart from the body of the impeller.

Referring to FIGS. 1 and 2, outer vanes 32, 34, 40 and 42 are configured to extend axially outwards from the top 28 of the body 27 and relative to the axis of rotation 25 shown in FIG. 1. These outer vanes also extend radially outwards with their distal ends at least partially facing the top 13 of the tank 11, the vanes thus extending in part in the direction of the axis of rotation and in part radially outwards. These vanes so configured thus promote upward movement of the liquid, as shown by arrow of numeral 43 for vane 42 in FIG. 1. Vanes 32 and 40 extend outwards from the top of the body at a greater angle relative to vanes 34 and 42. In this example, vanes 32 and 40, as shown by vane 40 in FIG. 5, are angularly spaced-apart from the top 28 of the body 27 at an angle $\alpha_1$ equal to 60 degrees. Vanes 34 and 42 are angularly spaced-apart from the top of the body at an angle $\alpha_2$ equal to 30 degrees, in this example.

As seen in FIGS. 1 and 4, outer vanes 36 and 44 are configured to extend axially outwards from bottom 29 of the body 27 and relative to the axis of rotation 25 shown in FIG. 1. These outer vanes extend radially outwards with their distal ends at least partially facing the bottom 14 of the tank 11 the vanes thus extending art in the direction of the axis of rotation and in part radially outwards. These vanes so configured promote downward movement of the liquid, as shown by arrow of numeral 47 for vane 44 in FIG. 1. Referring to FIG. 5, these vanes, as shown by vane 36, are angularly spaced-apart from the bottom 29 of the body 27 at an angle $\alpha_3$ equal to 30 degrees. Angles $\alpha_1$, $\alpha_1$ and $\alpha_3$ are provided by way of example only. Alternatively, one or more of the outer vanes may be angularly spaced-apart from the body 27 by an angle $\alpha_4$ equal to 45 degrees or an angle $\alpha_5$ equal to 80 degrees, for example.

Referring to FIGS. 1 and 2, outer vanes 30 and 38 are configured to extend radially outwards from the body 27, with their distal ends facing the side 15 of the tank 11. Each of the vanes, with vanes 30 and 38 in particular, are configured to promote centrifugal movement of the liquid, as shown by arrow of numeral 39 for vane 38 in FIG. 3.

Impeller 23 as herein described, with its channel-shaped, tapered vanes extending in a plurality of directions, may thus enable liquid or other substances within the tank 11 to be mixed in a more enhanced and efficient manner.

FIGS. 6 to 9 show an impeller 23.1 for the agitator assembly 10 shown in FIGS. 1 to 5 according to a second embodiment. Like parts have like numbers and function as the embodiment shown in FIGS. 1 to 5 with the addition of "0.1". Impeller 23.1 is substantially the same as impeller 23 shown in FIGS. 1 to 5 with the following exceptions.

Impeller 23.1 is particularly suited for mixing primarily liquid substances. The impeller has ten vanes 30.1, 32.1, 34.1, 38.1, 40.1, 42.1, 52, 54, 56 and 58 in this example. Vanes 32.1 and 52, 34.1 and 54, 40.1 and 56, and 42.1 and 58 are paired and aligned on opposite sides of body 27.1, respectively. For example, this is shown by vanes 32.1 and 52 in FIG. 6. The vanes are paired for operating balance. Each of the vanes 32.1 and 52, 34.1 and 54, 40.1 and 56, and 42.1 and 58 is substantially similar in shape. Vanes 32.1, 34.1, 40.1 and 42.1 extend radially and axially outwards from top 28.1 of the body 27.1 relative to the axis of rotation, with their distal ends, as shown by distal end 50.1 for vane 34.1, facing towards the top 13 of the tank 11 shown in FIG. 1. These vanes thus promote upward movement of the liquid.

Figure 7:
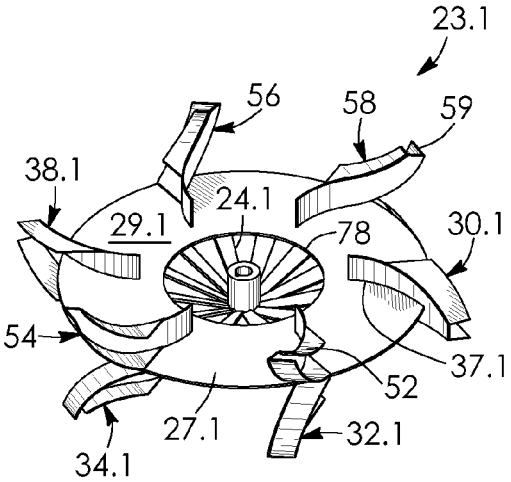
FIG. 7 is a bottom perspective view of the impeller shown in FIG. 6.

Referring to FIG. 7, vanes 52, 54, 56 and 58 extend radially and axially outwards from the bottom 29.1 of the body 27.1 relative to the axis of rotation, with their distal ends, as shown by distal end 59 for vane 58, facing towards the bottom 14 of the tank 11 shown in FIG. 1. These vanes thus promote downward movement of the liquid.

Figure 6:
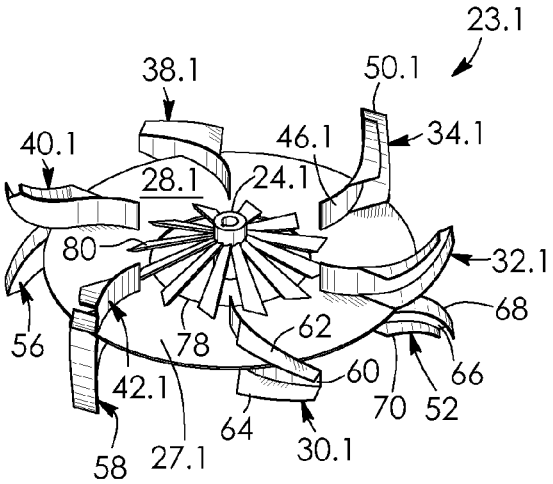
FIG. 6 is a top perspective view of an impeller according to a second embodiment.

Each vane is longitudinally curved and channel-shaped with a flat, quadrilateral top and bottom and a curved side which is longitudinally convex on the side facing the top and the bottom and longitudinally concave on the side facing away from its top and bottom. The tops and the bottoms of the outer vanes are tapered towards their outer ends. For outer vanes 30.1 and 38.1 this is shown in FIG. 6 with vane 30.1 having a side 60, top 62 and bottom 64. Similarly, vanes 32.1, 34.1, 40.1, 42.1, 52, 54, 56, and 58, as shown by vane 52 in FIG. 6, have sides 66, tops 68, and bottoms 70.

Figure 8:
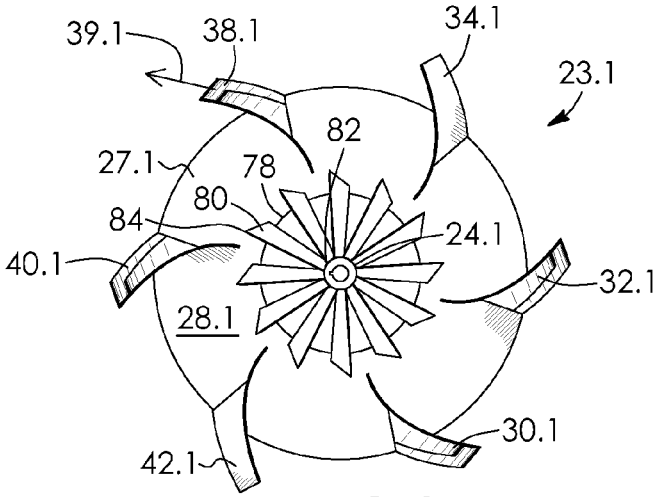
FIG. 8 is a top plan view of the impeller shown in FIG. 6.
Figure 9:
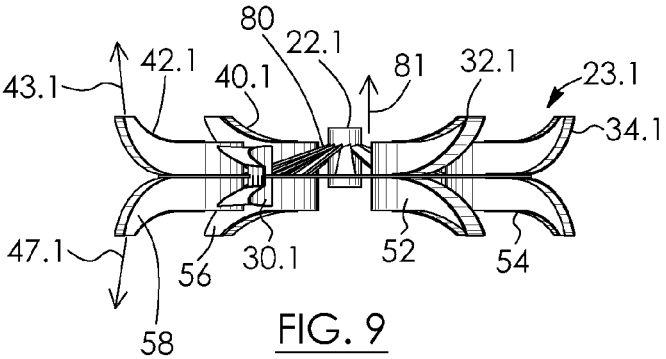
FIG. 9 is a side elevation view of the impeller shown in FIG. 6.

Body 27.1 is annular and has a central aperture 78. Impeller 23.1 has a plurality of inner vanes, for example inner vane 80, connected to the top 28.1 of the body 27.1, in this example. The inner vanes have proximal ends connected to the hub and radially-spaced-apart distal ends. This is shown in FIG. 8 for vane 80 with its proximal end 82 and distal end 84. The inner vanes are quadrilaterals in shape in this example, with the distal ends of the vanes being larger than their proximal ends. The inner vanes 80 are connected to hub 24.1 to position the hub in place such that the hub is co-axial with aperture 78. The inner vanes 80 extend radially outwards from the hub. The inner vanes are angled upwards relative to the top 28.1 of the body. The inner vanes 80 are configured to promote upward movement of liquid from the bottom 15 of the tank, through aperture 78, and towards the top 13 of the tank 11 shown in FIG. 1. This is shown by arrow of numeral 81 in FIG. 9. The inner vanes may thus inhibit solids within the tank from settling at the tank's bottom.

FIGS. 10 to 13 show an impeller 23.2 for the agitator assembly 10 shown in FIGS. 1 to 5 according to a third embodiment. Like parts have like numbers and function as the embodiment shown in FIGS. 1 to 5 with the addition of "0.2". Impeller 23.2 is substantially the same as impeller 23 shown in FIGS. 1 to 5 with the following exceptions.

Figure 10:
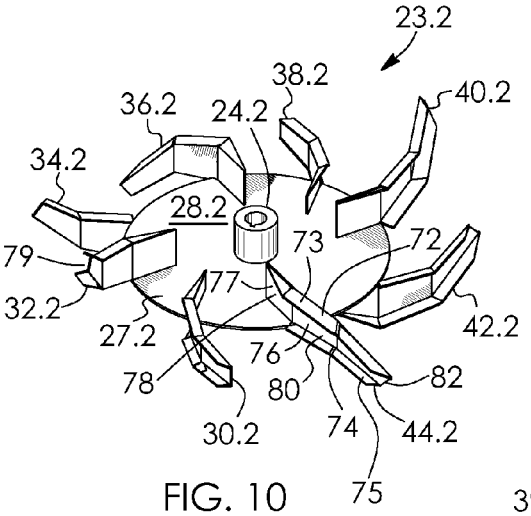
FIG. 10 is a top perspective view of an impeller according to a third embodiment.
Figure 11:
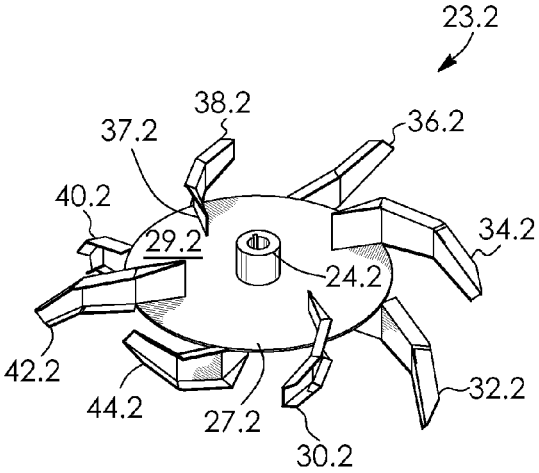
FIG. 11 is a bottom perspective view of the impeller shown in FIG. 10.
Figure 12:
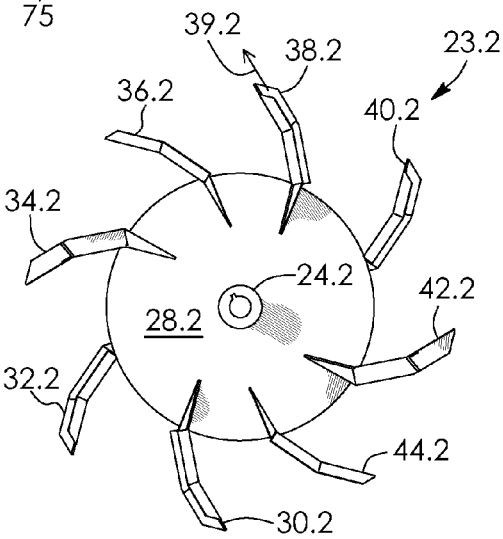
FIG. 12 is a top plan view of the impeller shown in FIG. 10.

Each vane, for example vane 44.2 in FIG. 10, has a top 72 in the form of a plurality of quadrilateral-shaped, angularly spaced-apart plates 73, in this example, aligned at least partially parallel with top 28.2 of the body, a bottom 74 in the form of a plurality of quadrilateral-shaped, angularly spaced-apart plates 75, in this example, aligned at least partially parallel with bottom 29.2 of the body as shown in FIG. 11, and a side 76 in the form of a plurality of quadrilateral-shaped, angularly spaced-apart plates 77 aligned perpendicular to the body 27.2. The channel-shaped vanes, in cross-section, form a trapezoidal space for receiving and directing liquid therethrough. This is shown by space 79 for vane 32.2 in FIG. 10. Each vane, as shown by vane 44.2 in FIG. 10, is formed by a plurality of segments including a first segment 78 connected to the body 27.2, a second segment 80 connecting to and angled relative to its first segment, and a third segment 82 connecting to and angled relative to its second segment. The first segments are partially rectangular in shape in this example and the second and third segments are trapezoidal in shape in this example. Each of the vanes 30.2, 32.2, 34.2, 36.2, 38.2, 40.2, 42.2 and 44.2 has segments 78, 80, and 82 that are connected together in a generally curved manner.

As seen in FIG. 10, vanes 32.2, 36.2, 40.2 and 44.2 are connected to and extend from the top 28.2 of the body 27.2. As seen in FIG. 11, vanes 34.2 and 42.2 are connected to and extend from the bottom 29.2 of the body. Referring to FIG. 10, vanes 32.2, 34.2, 40.2, and 42.2 are configured to extend upwards towards the top of the tank, for directing liquid in the upward direction. As shown in FIG. 11, vanes 36.2 and 44.2 are configured to extend downwards towards the bottom of the tank, for directing liquid in the downward direction.

Figure 13:
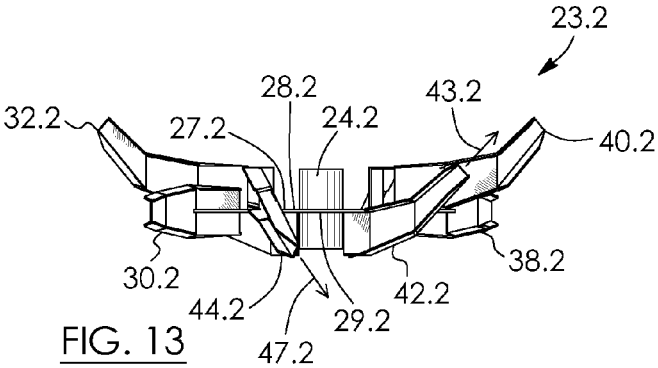
FIG. 13 is a side elevation view of the impeller shown in FIG. 10.

As seen in FIG. 13, vanes 30.2 and 38.2 connected to both the top 28.2 and bottom 29.2 of the body 27.2, with the body bisecting the proximal ends of these vanes. Vanes 30.2 and 38.2 are configured to extend radially outwards and their segments are generally tangentially curved.

Figure 14:
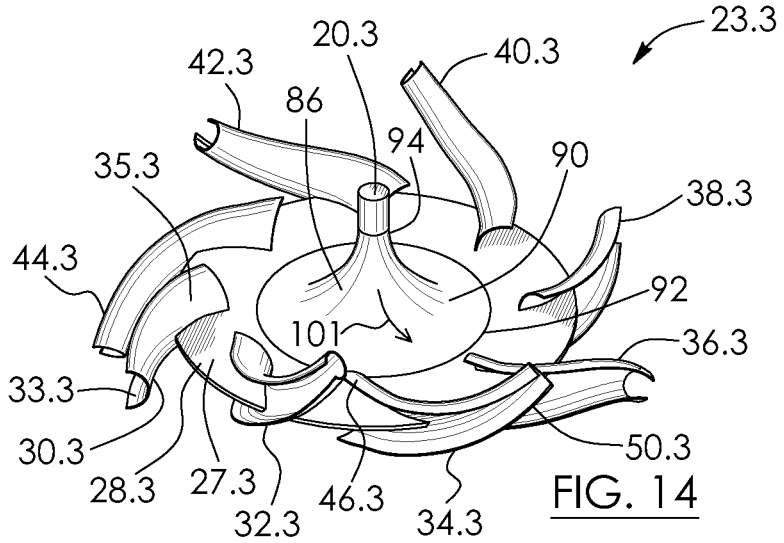
FIG. 14 is a top perspective view of an impeller according to a fourth embodiment, together with part of an agitator shaft connected thereto, the impeller having a pair of conical deflectors, only one of which being shown in FIG. 14.
Figure 15:
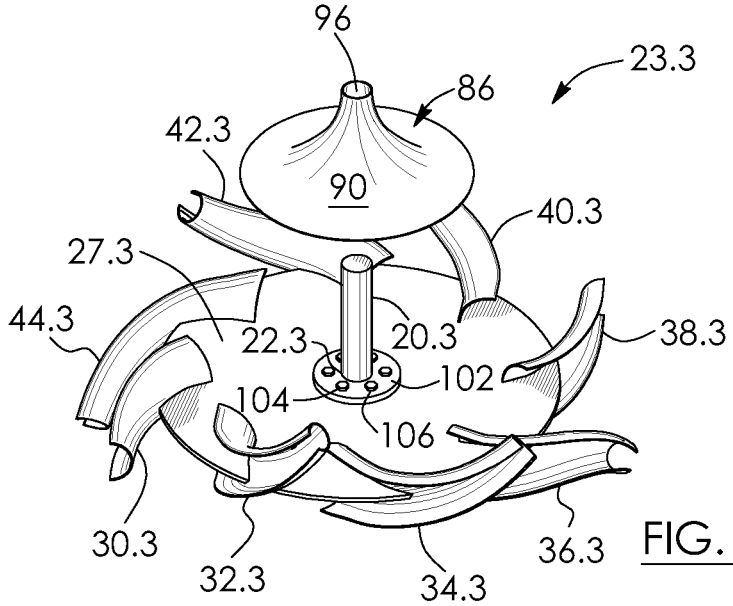
FIG. 15 is an exploded view of the impeller shown in FIG. 14, with one of the deflectors being shown spaced-apart and removed from the rest of the impeller.
Figure 16:
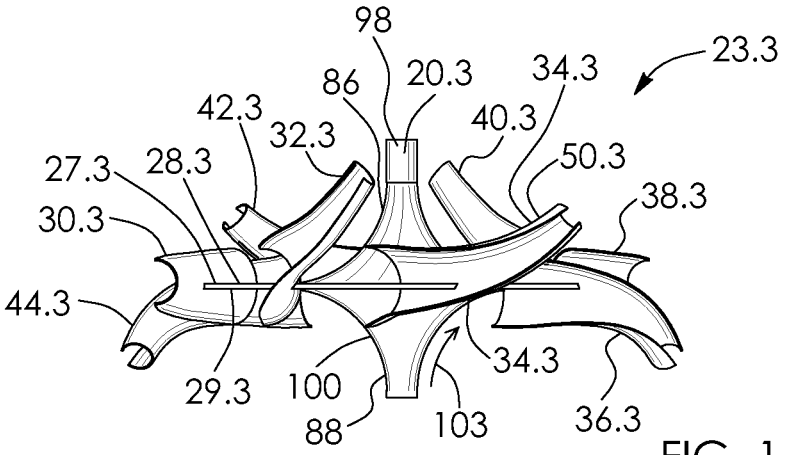
FIG. 16 is a side elevation view of the impeller shown in FIG. 14.

FIGS. 14 to 16 show an impeller 23.3 for the agitator assembly 10 shown in FIGS. 1 to 5 according to a fourth embodiment. Like parts have like numbers and function as the embodiment shown in FIGS. 1 to 5 with the addition of "0.3". Impeller 23.3 is substantially the same as impeller 23 shown in FIGS. 1 to 5 with the following exceptions.

Referring to FIGS. 14 and 16, the impeller has a pair of centrally disposed deflectors 86 and 88, mounted to the top 28.3 and bottom 29.3 of body 27.3, respectively. Each deflector is substantially the same as the other and therefore only deflector 86 will be described in detail. As seen in FIG. 15, deflector 86 is generally conical in shape and, in particular, has a concave frustoconical outer surface 90 in this example. Referring to FIG. 14, the deflector's proximal end 92 abuts top 28.3 of body 27.3, and is larger in radius relative to its distal end 94. As seen in FIG. 15, the deflector 86 has a central aperture 96 extending from end 92 to end 94 and configured to receive agitator shaft 20.3, as shown in FIG. 14, with the deflector snugly receiving the shaft at end 92 of the deflector.

Referring to FIGS. 14 and 16, the deflector 86 is curved and continuous in profile and provides a smooth path for the liquid to be agitated to pass therealong from the top 28.3 of the body 27.3, along the surface 90 and to the outer surface 98 of the shaft 20.3. In a like manner and referring to FIG. 16, deflector 88 is also curved in profile and provides a smooth path in profile between the bottom 29.3 of the body and the deflector's corresponding concave, conical surface 100. Deflector 86 is configured to direct liquid in an axially downward and radially outward direction, as shown by arrow of numeral 101 in FIG. 14. Put another way, deflector 86 is configured to direct liquid downward and outward towards portions of the proximal ends 46.3 of the vanes disposed above the body 27.3, driving the flow of liquid out through the distal ends 50.3 of the vanes. Referring to FIG. 16, deflector 88 is configured to direct liquid an axially upward and radially outward direction, as shown by arrow of numeral 103, towards portions of the proximal ends of the vanes disposed below the body 27.3, driving the flow of liquid out through the distal ends of the vanes. The deflectors may be welded to the body 27.3 or frictionally engage with the shaft 20.3.

As seen in FIG. 15, shaft 20.3 has a flange 102 connected to its second end 22.3, by welding in this example. The flange has a plurality of radially spaced-apart apertures 104. The body 27.3 has a plurality of corresponding apertures, and the flange 102 is connectable to the impeller 23.3 by way of a plurality of connectors passing through said apertures. In this example the connectors are in the form of bolts and nuts 106, though they may be rivets, for example, according to another embodiment.

Figure 17:
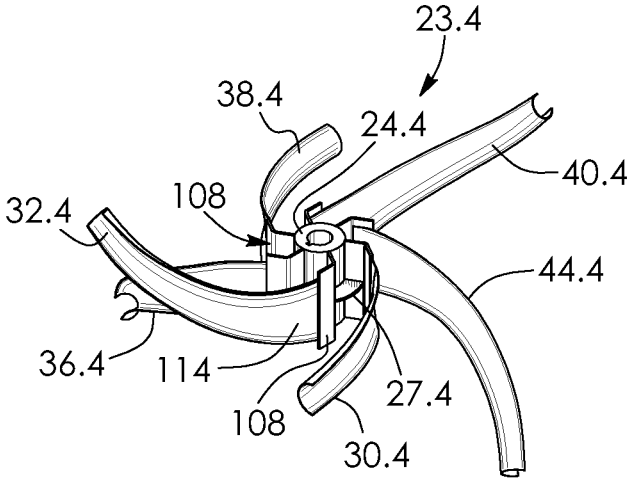
FIG. 17 is a top perspective view of an impeller according to a fifth embodiment.
Figure 18:
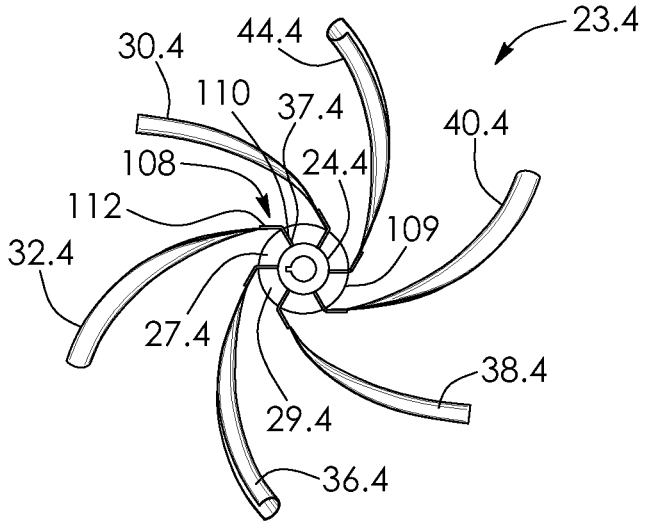
FIG. 18 is a bottom plan view of the impeller shown in FIG. 17.
Figure 19:
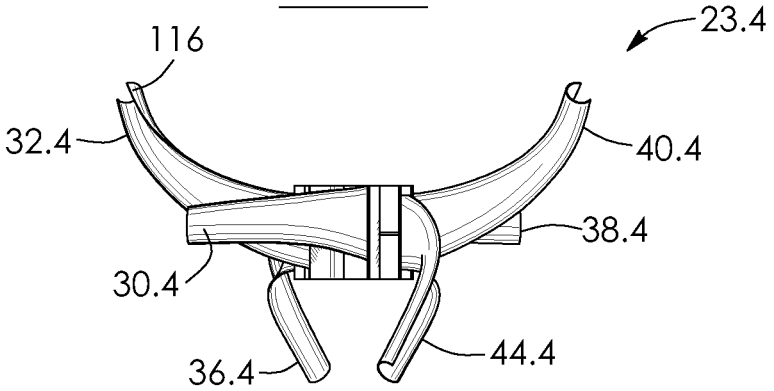
FIG. 19 is a side elevation view of the impeller shown in FIG. 17.

FIGS. 17 to 19 show an impeller 23.4 for the agitator assembly 10 shown in FIGS. 1 to 5 according to a fifth embodiment. Like parts have like numbers and function as the embodiment shown in FIGS. 1 to 5 with the addition of "0.4". Impeller 23.4 is substantially the same as impeller 23 shown in FIGS. 1 to 5 with the following exceptions.

Impeller 23.4 has a plurality of radially spaced-apart, vertically-aligned connector plates, as shown by plate 108 in FIG. 17, connected to and extending radially outwards from the hub 24.4. Body 27.4 is also centrally connected to and extends around hub 24.4. The body is relatively small compared to the embodiments shown in FIGS. 1 to 16. Referring to FIG. 18, each of the plates has a first portion 110 that extends through a respective one of the radially spaced-apart slots 37.4 of the body. Each of the plates 108 also has a second portion 112 that extends tangential to the circular outer edge 109 of the body 27.4. The second portions are bent relative to the first portions and both the first and second portions are generally rectangular in shape in this example. The connector plates 108 may function to reinforce body 27.4 and impeller 23.4 generally.

Each of the outer vanes 30.4, 32.4, 36.4, 38.4, 40.4 and 44.4 has a proximal end that is flat, as shown by end 114 for vane 32.4 in FIG. 17. The connector plates 108 connect the proximal ends of the outer vanes to the body 27.4. This connection may be by way of welding, for example, though this is not strictly required and other ways of connecting the vanes to the connector plates are possible. Each of the outer vanes 30.4, 32.4, 36.4, 38.4, 40.4 and 44.4 has a distal end that is c-shaped in cross-section, as seen in FIG. 19 by distal end 116 for vane 32.4. The vanes fully extend outwards from the body 27.4 and do not directly connect with the body.

Figure 20:
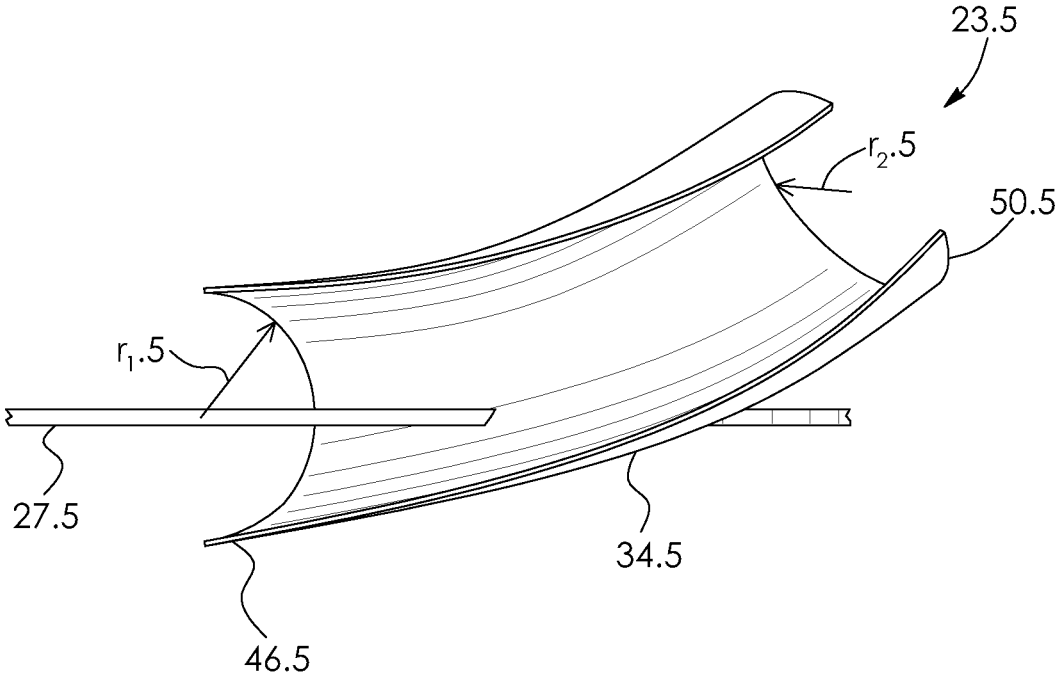
FIG. 20 is a top perspective view of part of an impeller according to a sixth embodiment.

FIG. 20 shows part of an impeller 23.5 for the agitator assembly 10 shown in FIGS. 1 to 5 according to a sixth embodiment. Like parts have like numbers and function as the embodiment shown in FIGS. 1 to 5 with the addition of "0.5". Impeller 23.5 is substantially the same as impeller 23 shown in FIGS. 1 to 5 with the exception that each of its outer vanes are non-tapered. Each of the vanes is substantially identical to those vanes shown in FIGS. 1 to 5 and therefore only vane 34.5 is shown and will be described. The proximal end 46.5 of vane 34.5 is equal in size to distal end 50.5 of vane 34.5. The radius of curvature $r_i$.5 for each of the ends 46.5 of the vanes is also equal in size to the radius of curvature $r_2$.5 of each of the ends 50.5 of the vanes.

It will be appreciated that yet further variations are possible within the scope of the invention described herein. For example, as mentioned above, the number of vanes may vary. Also, the angular positioning of the outer vanes may vary. The vanes may connect at their proximal ends to the top, the bottom, or both the top and bottom of the body of the impeller. The vanes may be fully curved or partially curved. The vanes may be formed with a plurality of plates welded together.

It also will be understood by someone skilled in the art that many of the details provided above are by way of example only and are not intended to limit the scope of the invention which is to be determined with reference to the following claims.

What is claimed is:

1. A mixing impeller for an agitator, the impeller comprising:

an annular body having a top, a bottom opposite the top and a central aperture;

a central hub that connects with a shaft, the hub being co-axial with the central aperture of the body;

a plurality of inner vanes connected to one of the top and the bottom of the body, the inner vanes having proximal ends connected to the hub and radially spaced-apart distal ends, the inner vanes positioning the hub in place, the inner vanes being configured to promote movement of liquid from the bottom of the body, through said aperture, and towards the top of the body; and a plurality of radially spaced-apart, longitudinally curved, channel-shaped outer vanes connected to and extending outwards from the body in a plurality of different directions, each of the outer vanes having a proximal end adjacent to the body and a distal end spaced-apart from the body, and each of said outer vanes being curved in a direction extending between its proximal end and its distal end.

2. The impeller as claimed in claim 1 wherein the proximal ends of the outer vanes operatively connect to the body and wherein respective one of the distal ends of the outer vanes are radially spaced-apart from corresponding respective ones of the proximal ends of the outer vanes.

3. The impeller as claimed in claim 1, wherein the distal end of a the first one of the outer vanes at least partially faces above the body, wherein the distal end of a second one of the outer vanes at least partially faces below the body and wherein the distal end of a third one of the outer vanes at least partially faces tangential to the body.

4. The impeller as claimed in claim 1, wherein the impeller has an axis of rotation, wherein a first one of the outer vanes is configured to extend radially outwards from the body, and wherein a second one of the outer vanes is configured to extend in a part in the direction of the axis of rotation and to extend in part radially outwards from the body.

5. The impeller as claimed in claim 4, wherein the outer vanes are circumferentially spaced-apart about the body and wherein at least one of the outer vanes is at least partially bisected by the body.

6. The impeller as claimed in claim 2, wherein each outer vanes has a radius of curvature at its proximal end and a radius of curvature at its distal end, the radius of curvature at the proximal ends of the outer vanes being greater than the radius of curvature at the distal ends of the outer vanes.

7. The impeller as claimed in claim 2, wherein each of the outer vanes has a radius of curvature at its proximal end and a radius of curvature at its distal end, the radius of curvature at the proximal ends of the outer vanes being equal to the radius of curvature at the distal ends of the outer vanes.

8. The impeller as claimed in claim 1 wherein each of the outer vanes has a side that extends outwards and perpendicular from the body, a top at least partially facing the body and a bottom opposite the top, the tops and the bottoms of the outer vanes tapering towards each other as the outer vanes extend radially outwards from the body.

9. The impeller as claimed in claim 8 wherein the impeller has an axis of rotation, wherein each side of the vanes is curved and wherein the outer vanes extend in part in the direction of the axis of rotation and extend in part radially outwards from the body.

10. The impeller as claimed in claim 1 wherein the impeller has an axis of rotation, wherein each of the outer distal ends of the outer vanes is c-shaped in section, and wherein each of the outer vanes has a convex side and a concave side.

11. The impeller as claimed in claim 1 wherein the each of the outer vanes, in cross-section, forms a trapezoidal space for receiving and directing liquid therethrough.

12. The impeller as claimed in claim 1, further including a centrally disposed deflector connected to the body, the deflector having a concave frustoconical outer surface.

13. The impeller as claimed in claim 12, wherein the impeller has an axis of rotation, wherein the deflector connects to the top of the body and is configured to direct liquid in an axially downward and radially outward direction relative to the axis of rotation, and wherein the impeller has a further deflector having a concave frustoconical outer surface, the further deflector connecting to the bottom of the body and being configured to direct liquid in an axially upward and radially outward direction relative to the axis of rotation.

14. An agitator having a housing, an actuator mounted to the housing, a shaft rotatably connected to the actuator and the impeller as claimed in claim 1, the impeller being fixedly mounted to the shaft.

15. A mixing impeller for an agitator, the impeller comprising:

a body having a circular outer edge;

a central hub connectable to an agitator shaft, the body connecting to and extending around the hub;

a plurality of radially spaced-apart, vertically-aligned connector plates connected to and extending radially outwards from said hub, the plates each having a portion that extends tangential to the outer edge of the body; and a plurality of radially spaced-apart, longitudinally curved, channel-shaped outer vanes connected to and extending outwards from the body in a plurality of different directions, each of the outer vanes having a proximal end adjacent to the body and a distal end spaced-apart from the body, each of said outer vanes being curved in a direction extending between its proximal end and its distal end, the connector plates connecting the outer vanes to the body and the vanes connecting to respective ones of said portions of the plates.

16. An agitator having a housing, an actuator mounted to the housing, a shaft rotatably connected to the actuator and the impeller as claimed in claim 15, the impeller being fixedly mounted to the shaft.

17. The mixing impeller as claimed in claim 1, wherein at least some of the outer vanes are configured to promote centrifugal movement of the liquid.

18. The mixing impeller as claimed in claim 12, wherein the deflector connects to the top of the body and is configured to direct liquid downward and outward towards portions of the proximal ends of the outer vanes disposed above the body, driving the flow of liquid out through the distal ends of the outer vanes.

* * * * *

UNITED STATES PATENT AND TRADEMARK OFFICE

CERTIFICATE OF CORRECTION

PATENT NO. : 9,108,170 B2
APPLICATION NO. : 13/304368
DATED : August 18, 2015
INVENTOR(S) : Li Wang and Tianzhi Wang It is certified that error appears in the above-identified patent and that said Letters Patent is hereby corrected as shown below:

In the claims

Column 7 line 65 to Column 8 line 2 should read as
2. The impeller as claimed in claim 1 wherein the proximal ends of the outer vanes operatively connect to the body and wherein respective ones of the distal ends of the outer vanes are radially spaced-apart from corresponding respective ones of the proximal ends of the outer vanes.

Column 8 lines 3-8 should read as
3. The impeller as claimed in claim 1, wherein the distal end of a first one of the outer vanes at least partially faces above the body, wherein the distal end of a second one of the outer vanes at least partially faces below the body and wherein the distal end of a third one of the outer vanes at least partially faces tangential to the body.

Column 8 lines 9-14 should read as
4. The impeller as claimed in claim 1, wherein the impeller has an axis of rotation, wherein a first one of the outer vanes is configured to extend radially outwards from the body, and wherein a second one of the outer vanes is configured to extend in part in the direction of the axis of rotation and to extend in part radially outwards from the body.

Column 8 lines 19-23 should read as
6. The impeller as claimed in claim 2, wherein each of the outer vanes has a radius of curvature at its proximal end and a radius of curvature at its distal end, the radius of curvature at the proximal ends of the outer vanes being greater than the radius of curvature at the distal ends of the outer vanes.

Column 8 lines 35-39 should read as
9. The impeller as claimed in claim 8 wherein the impeller has an axis of rotation, wherein each of the sides of the outer vanes is curved and wherein the outer vanes extend in part in the direction of the axis of rotation and extend in part radially outwards from the body.

Signed and Sealed this
Second Day of February, 2016

Michelle K. Lee

Michelle K. Lee
*Director of the United States Patent and Trademark Office*

Column 8 lines 40-43 should read as
10. The impeller as claimed in claim 1 wherein the impeller has an axis of rotation, wherein each of the distal ends of the outer vanes is c-shaped in section, and wherein each of the outer vanes has a convex side and a concave side.

Column 8 lines 44-46 should read as
11. The impeller as claimed in claim 1 wherein each of the outer vanes, in cross-section, forms a trapezoidal space for receiving and directing liquid therethrough.